US006145779A

United States Patent [19]

Johnson et al.

[11] Patent Number: 6,145,779

[45] Date of Patent: Nov. 14, 2000

[54] DUAL ROLL TRANSFER DISPENSER

[75] Inventors: Darrell R. Johnson, Woodstock; Ricky W. Purcell, Alpharetta; Ronald R. Arvay, Marietta, all of Ga.

[73] Assignee: Kimberly-Clark Worldwide, Inc., Neenah, Wis.

[21] Appl. No.: 09/404,084

[22] Filed: Sep. 23, 1999

[51] Int. Cl.[7] ..... B65H 19/00

[52] U.S. Cl. ..... 242/560.1; 242/564.2

[58] Field of Search ..... 242/560, 560.1, 242/564.1, 564.4, 564.5, 563, 563.2, 564.2

[56] References Cited

U.S. PATENT DOCUMENTS

| | | | |
|---|---|---|---|
| 2,308,840 | 1/1943 | Vaughan et al. . | |
| 2,380,644 | 7/1945 | Grondona . | |
| 2,726,823 | 12/1955 | Jespersen . | |
| 2,790,608 | 4/1957 | Sieven . | |
| 2,830,775 | 4/1958 | Kiesel . | |
| 3,007,650 | 11/1961 | Burton . | |
| 3,084,006 | 4/1963 | Roemer . | |
| 3,288,387 | 11/1966 | Craven, Jr. . | |
| 3,580,651 | 5/1971 | Gauper . | |
| 3,628,743 | 12/1971 | Bastian et al. . | |
| 3,948,454 | 4/1976 | Bastian . | |
| 4,010,909 | 3/1977 | Bastian | 242/560.1 |
| 4,067,509 | 1/1978 | Graham, Jr. et al. | 242/560.1 |
| 4,106,684 | 8/1978 | Hartbauer et al. | 242/560.1 X |
| 4,148,442 | 4/1979 | Baumann et al. | 242/560.1 |
| 4,165,138 | 8/1979 | Hedge et al. | 242/560 |
| 4,314,679 | 2/1982 | Paul et al. . | |
| 4,317,547 | 3/1982 | Graham, Jr. et al. | 242/560.1 |
| 4,358,169 | 11/1982 | Filipowicz et al. | 242/560.1 X |
| 4,383,656 | 5/1983 | Campbell . | |
| 4,756,485 | 7/1988 | Bastian et al. . | |
| 5,244,161 | 9/1993 | Wirtz-Odenthal | 242/560.1 |
| 5,253,818 | 10/1993 | Craddock . | |
| 5,302,167 | 4/1994 | Kley et al. | 242/560.1 X |
| 5,370,336 | 12/1994 | Whittington . | |
| 5,400,982 | 3/1995 | Collins | 242/560 |
| 5,495,997 | 3/1996 | Moody . | |
| 5,497,959 | 3/1996 | Johnson et al. . | |
| 5,558,302 | 9/1996 | Jesperson | 242/560 |
| 5,618,008 | 4/1997 | Dearwester et al. . | |
| 5,636,812 | 6/1997 | Conner et al. . | |
| 5,868,275 | 2/1999 | Moody . | |

FOREIGN PATENT DOCUMENTS

| | | |
|---|---|---|
| 0842881A2 | 5/1998 | European Pat. Off. . |
| 9626878 | 9/1996 | WIPO . |

*Primary Examiner*—Donald P. Walsh
*Assistant Examiner*—William A. Rivera
*Attorney, Agent, or Firm*—Dority & Manning

[57] ABSTRACT

A dual roll dispenser includes a housing having first and second roll retaining devices for holding at least two rolls within the housing. A feed mechanism is disposed in the housing to dispense material from the first roll and second roll in a sequential feeding operation. A guide member is disposed within the housing and is movable between a staging position spaced from the feed mechanism and an operating position wherein the guide member contacts and moves material from the second roll to a dispensing nip of the feed mechanism for subsequent dispensing of material from the second roll upon the first roll being depleted to a predetermined degree. A movable trigger device is disposed against the outer circumferential surface of the first roll and moves in a path as the first roll is reduced in diameter upon depletion thereof. When the first roll is depleted to a certain diameter, the trigger device passes beyond and out of contact with the first roll into a trigger position. The trigger device is operably connected to the guide member so as to move the guide member to the operating position upon the trigger device moving to the trigger position.

16 Claims, 7 Drawing Sheets

DUAL ROLL TRANSFER DISPENSER

BACKGROUND OF THE INVENTION

The present invention relates generally to a multiple roll dispenser, and more particularly to a dual roll dispenser incorporating a transfer mechanism for transferring the dispensing operation from a first roll to a second roll upon depletion of the first roll.

Dual or multiple roll dispensers are well known in the art. Examples of such dispensers are provided in U.S. Pat. Nos. 4,756,485; 3,628,743; 3,007,650; and 3,288,387. Such dispensers typically incorporate a transfer mechanism or device to ensure sequential dispensing of sheet material from an additional roll upon the first roll being depleted a predetermined amount. The reliability, effectiveness, and complexity of these transfer mechanisms is an important consideration and the industry is continuously concerned with improving such devices and the overall operation of the multiple or dual roll dispensers.

The present invention relates to a dual roll dispenser having an effective and reliable transfer mechanism.

SUMMARY OF THE INVENTION

Objects and advantages of the invention will be set forth in part in the following description, or may be obvious from the description, or may be learned through practice of the invention.

In accordance with the invention, a roll dispenser is provided and configured for dispensing at least two rolls of material. The present dispenser is not limited to any particular type of roll material or any particular application. The invention is particularly useful for dispensing rolls of paper or web material, but has application wherever multiple rolls of material of any type are desired to be dispensed from a single dispenser.

The roll dispenser according to the invention includes a housing defining an enclosure for the rolls and dispensing mechanism. The housing includes a first roll retaining device and a second roll retaining device for holding at least first and second rolls of material within the housing. The roll retaining devices may have various configurations, including resilient wire arm members that engage within the cores of the rolls. Spindles, rollers, or any other suitable roll retaining device are within the scope and spirit of the invention. The retaining devices may be positioned or disposed within the housing so that the first and second rolls are in a generally vertically stacked arrangement within the housing. This type of arrangement is beneficial in reducing the depth of the housing and roll dispenser in general.

A feed mechanism is disposed within the housing to dispense material from the rolls. Conventional feed mechanisms that include a drivable feed roller and a nip roller disposed against the feed roller are well known to those skilled in the art and may be utilized in the present invention. The present dispenser may incorporate such a feed roller and nip roller arrangement. The feed roller and nip roller define a dispensing nip through which the roll material is frictionally engaged and dispensed from the housing. The feed roller is driven or actuated automatically or manually. In one embodiment of the present invention, the feed roller is driven by a manual actuating member extending from the housing. For example, the actuating member may comprise a lever that is geared or otherwise operably connected to the feed roller so that a user of the device simply moves the lever which causes the feed roller to rotate and to dispense material through the dispensing nip and out of the housing. In an alternative embodiment, the feed roller may be driven by a powered device, electric device, etc. A number of mechanisms and devices are well known in the art for driving such feed mechanisms and all such devices are within the scope and spirit of the invention.

The present roll dispenser may also include a movable guide member disposed within the housing. The guide member is movable between a staging position wherein it is spaced from the dispensing nip, and an operating position wherein the guide member contacts and moves sheet material from the second roll into the dispensing nip so that such material is then dispensed through the feed mechanism. In one embodiment of the invention, the guide member may comprise a deflection roller that is disposed longitudinally across a running path of the material from the second roll. In its staging position, the deflection roller may deflect the material from the second roll to a holding member, such as a clip, pin, or the like, that retains the second roll material remote from the feed mechanism. When the guide member or deflection roller moves into its operating position, it deflects and causes the roll material to be withdrawn from the holding member and directed into the dispensing nip.

The roll dispenser also includes a movable trigger device that is biased and disposed so as to contact against a longitudinal circumferential surface of the first roll. The trigger device is maintained in contact against the circumferential surface of the roll as the roll is reduced in diameter upon depletion thereof. In this regard, the trigger device may comprise a roller that is mounted within the housing so as to have an axis that is substantially parallel to the axis of the first roll and the guide member. Upon the first roll being depleted to a certain diameter, the trigger device or roller passes beyond and out of contact with the first roll to a trigger position. The trigger device is operably connected, for example through a mechanical link, to the guide member or deflection roller so as to move the guide member or deflection roller to the operating position upon the trigger device moving out of contact with the first roll and to its trigger position.

In an embodiment of the invention, the trigger device is a roller that is pivotally mounted below the first retaining device and is movable in an arc as the diameter of the first roll is reduced. Eventually, the diameter of the first roll is reduced to such a degree that the trigger device will pass below and move out of contact with the first roll. Once the trigger device loses contact with the roll, it will continue to move in its arc to the trigger position. This continued motion of the trigger device to its trigger position will cause the guide member or deflection roller to then move to the operating position.

The linkage or operable connection between the trigger device and guide member may be accomplished in various ways. For example, any configuration of mechanical linkage arms, pivots, etc. may be utilized to transfer motion of the trigger device to the guide member or deflection roller.

The invention will be described in greater detail below through use of the appended of the figures.

DETAILED DESCRIPTION

Figure 1:
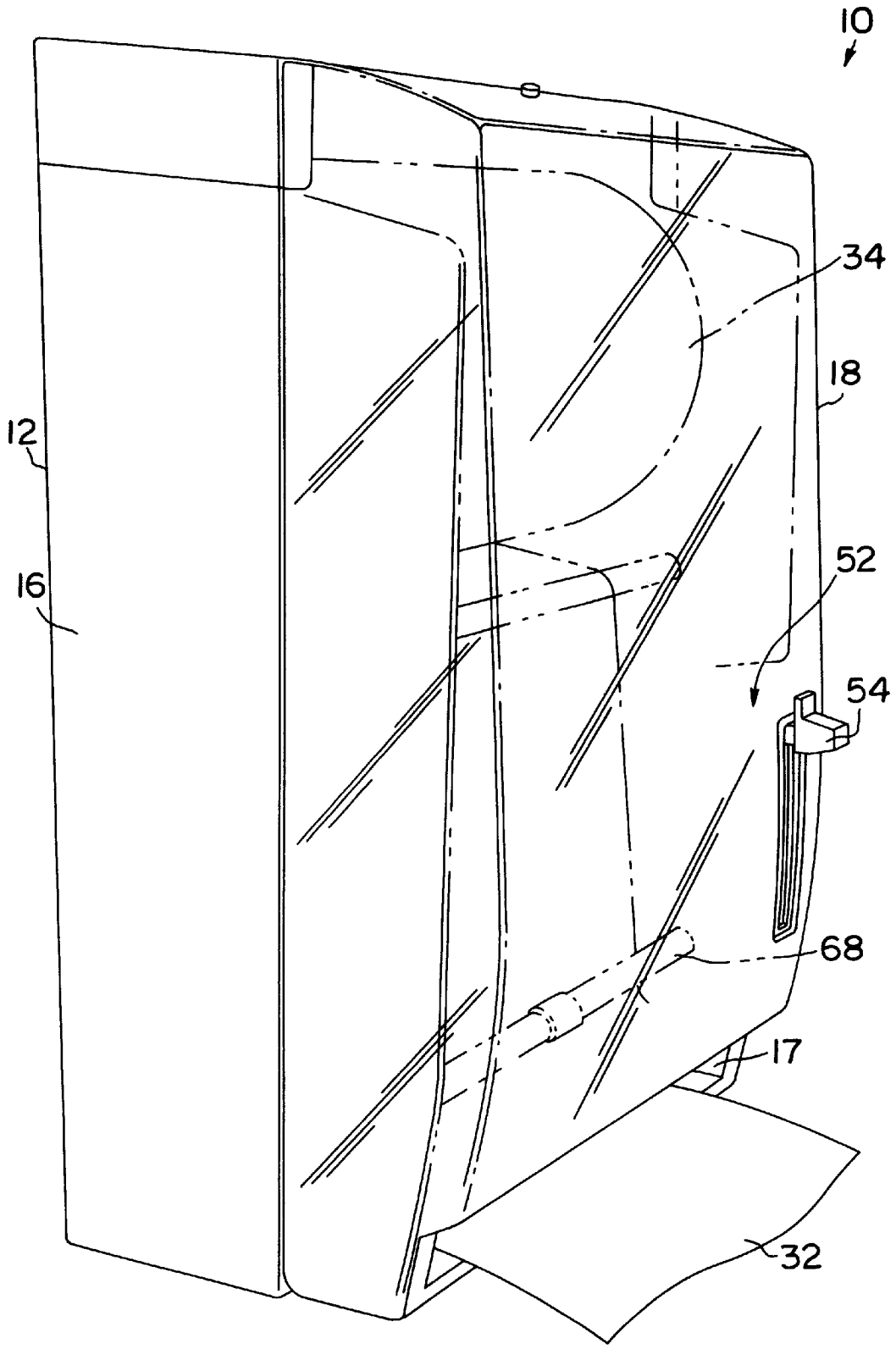
FIG. 1 is a perspective view of a dual roll dispenser according to the present invention.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

A dispenser, generally 10, according to the invention is illustrated in the figures. The dispenser is configured for dispensing multiple rolls of material. The dispenser is not limited to any particular type of roll material, or any particular application. The dispenser is illustrated in the figures as a paper towel roll dispenser for purposes of illustration only.

Dispenser 10 includes a housing 12. The housing may take on any manner of shape or configuration. In the figures, housing 12 is defined by sides 16, a back surface 14, and a front surface 18. Front surface 18 may be removable from the remaining portion of housing 12 for purposes of loading and maintaining dispenser 10. A dispensing slot 17 is formed in the housing through which the roll or sheet material is dispensed, as particularly seen in FIG. 1.

Figure 2:
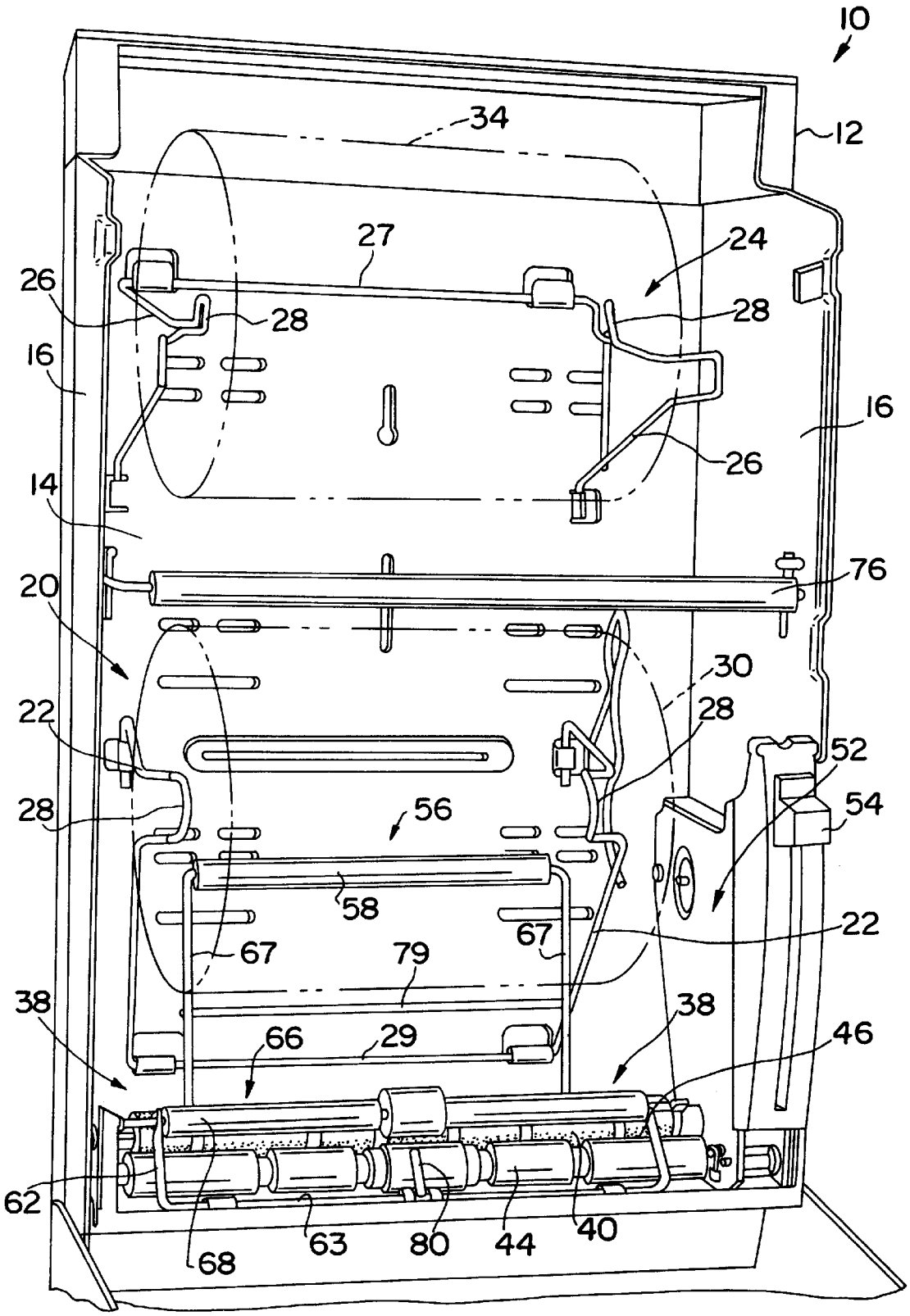
FIG. 2 is a frontal component view of the dispenser illustrated in FIG. 1.

Dispenser 10 includes devices for retaining at least two rolls of material therein. Referring to FIGS. 1 and 2 in particular, a first retaining device 20 is provided for holding a first roll 30, and a second retaining device 24 is provided for holding a second roll 34. The retaining devices also may take on any manner of configuration so long as they securely hold the rolls in position within housing 12. In the embodiment illustrated, second retaining device 24 is defined by wire arms 26 connected by a back wire member 27 that is mounted to housing 12, as particularly illustrated in FIG. 2. Preferably, wire arms 26 are flexed inward so as to apply a compressive holding force to roll 34. Wire arms 26 may include core engaging members 28 at the ends thereof.

Figure 5A:
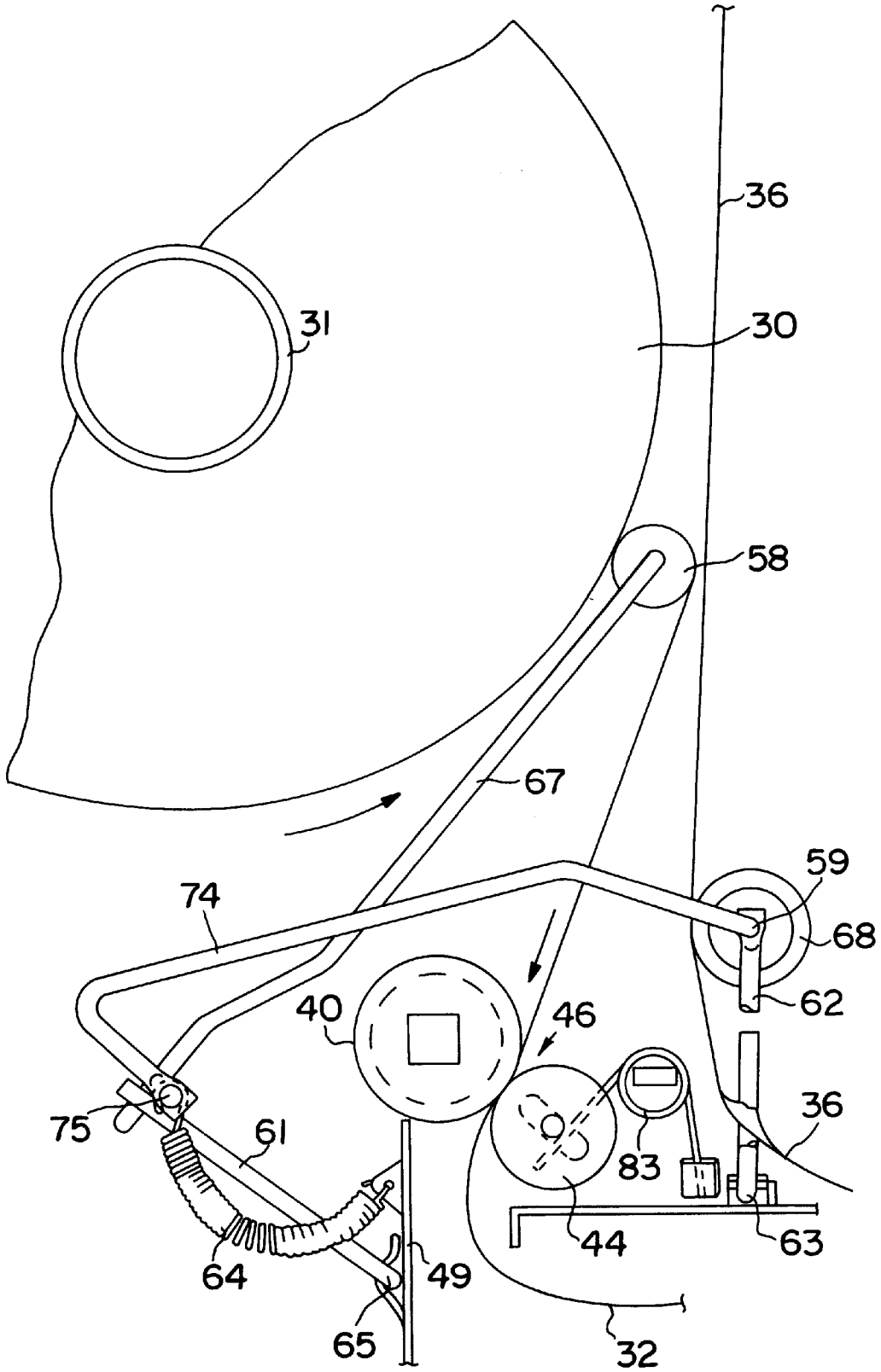
FIGS. 5*a* through 5*c* are cross-sectional operational views of the feed mechanism and trigger device according to the invention.

First roll retaining device 20 is similar to second roll retaining device 24 in that it may also be formed by wire arms 22 mounted to back wall 14 of housing 12 by connecting member 29. Wire arms 22 define a core engaging member or device 28 at the ends thereof for securely retaining first roll 30 by engagement with core 31 (FIG. 5*a*).

In the embodiment illustrated, the roll retaining devices are disposed and oriented within housing 12 so that rolls 34 and 30 are essentially vertically aligned within housing 12. This arrangement minimizes the depth that housing 12 extends from a wall or other surface on which the dispenser 10 is mounted.

Figure 4:
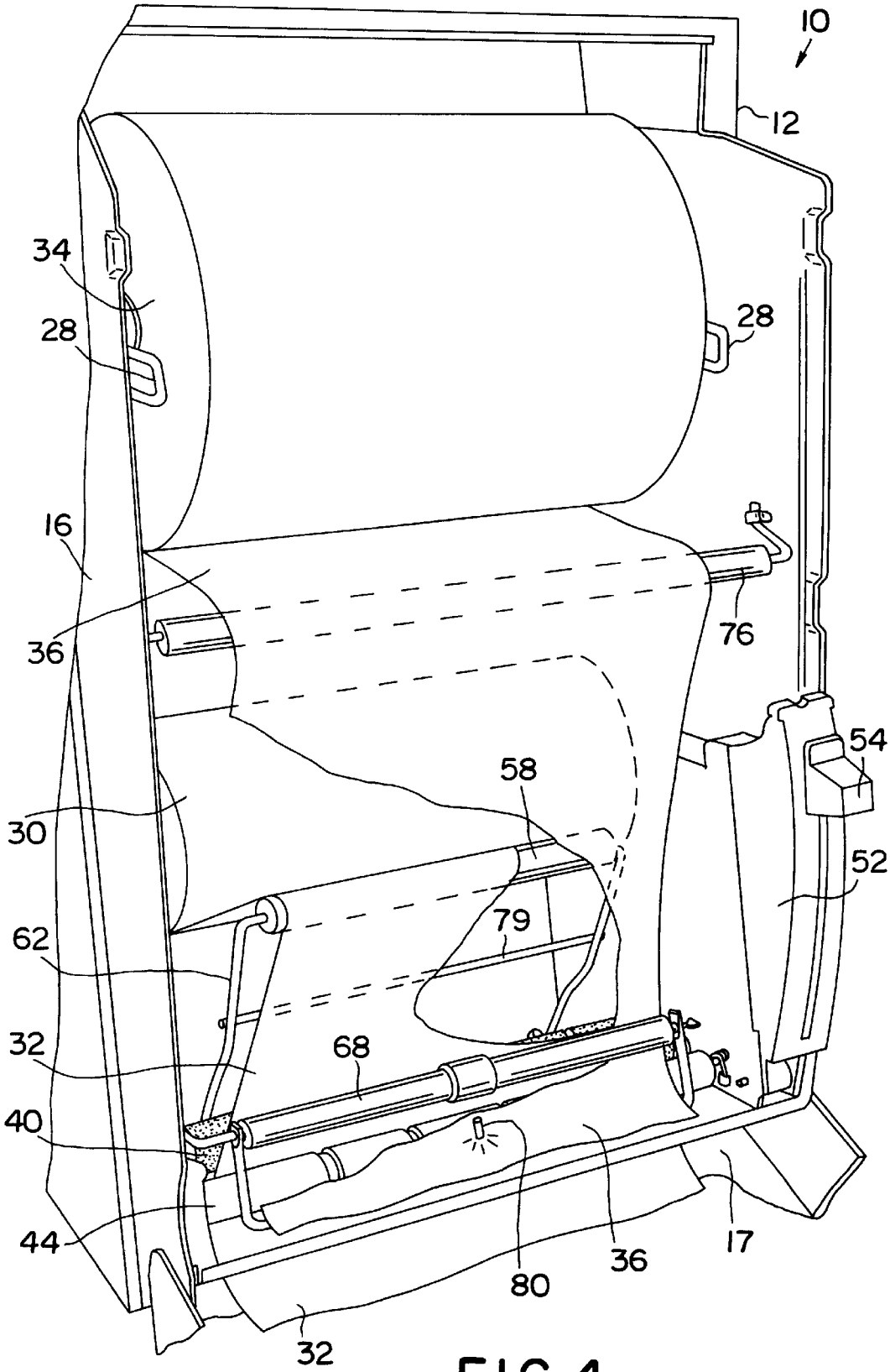
FIG. 4 is a perspective operational view of the dispenser.

Dispenser 10 also includes a feed mechanism, generally 38. The feed mechanism 38 is disposed within housing 12 to dispense roll material from the first roll 30 and then from the second roll 34 in a controlled manner. FIGS. 1 and 4 illustrate roll material 32 being dispensed from first roll 30. As explained in greater detail below, upon first roll 30 being reduced to a predetermined diameter, roll material 36 will then be fed to feed mechanism 38 for subsequent dispensing thereof. Until that point in time, roll material 36 is directed over a guide or diverting roller 76 and the leading edge thereof is held within housing 12 by any suitable device, such as a pin 80 particularly illustrated in FIGS. 2 and 4. Any device, such as a clamp, etc., may be utilized in this regard.

Feed mechanism 38 may comprise a conventional feed roller 40 and nip roller 44 type of arrangement. These arrangements are well known by those skilled in the art. A feed roller 40 is mechanically driven so as to advance sheet or rolled material through a nip 46 defined between feed roll 40 and a nip roller 44. Preferably, feed roller 40 is formed from a material to enhance the frictional advancement of the roll material through nip 46. Roll 40 is generally rotatable on a fixed axis secured within housing 12. Nip roller 44 may be biased against feed roller 40 by any suitable device, such as torsion spring 83 illustrated in the figures.

Referring particularly to FIGS. 1, 2, and 4, an actuating device, generally 52, is provided for driving feed roller 40. Actuating device 52 may include a conventional lever 54 or other manual operating device. In the embodiment illustrated, a gear arrangement, not shown in detail, is provided for driving feed roller 40. The gear arrangement transfers the manual movement of lever 54 to a rotational drive for roller 40. This type of gear arrangement and actuating device 52 are well by those skilled in the art and are not particular to the present invention.

Figure 3:
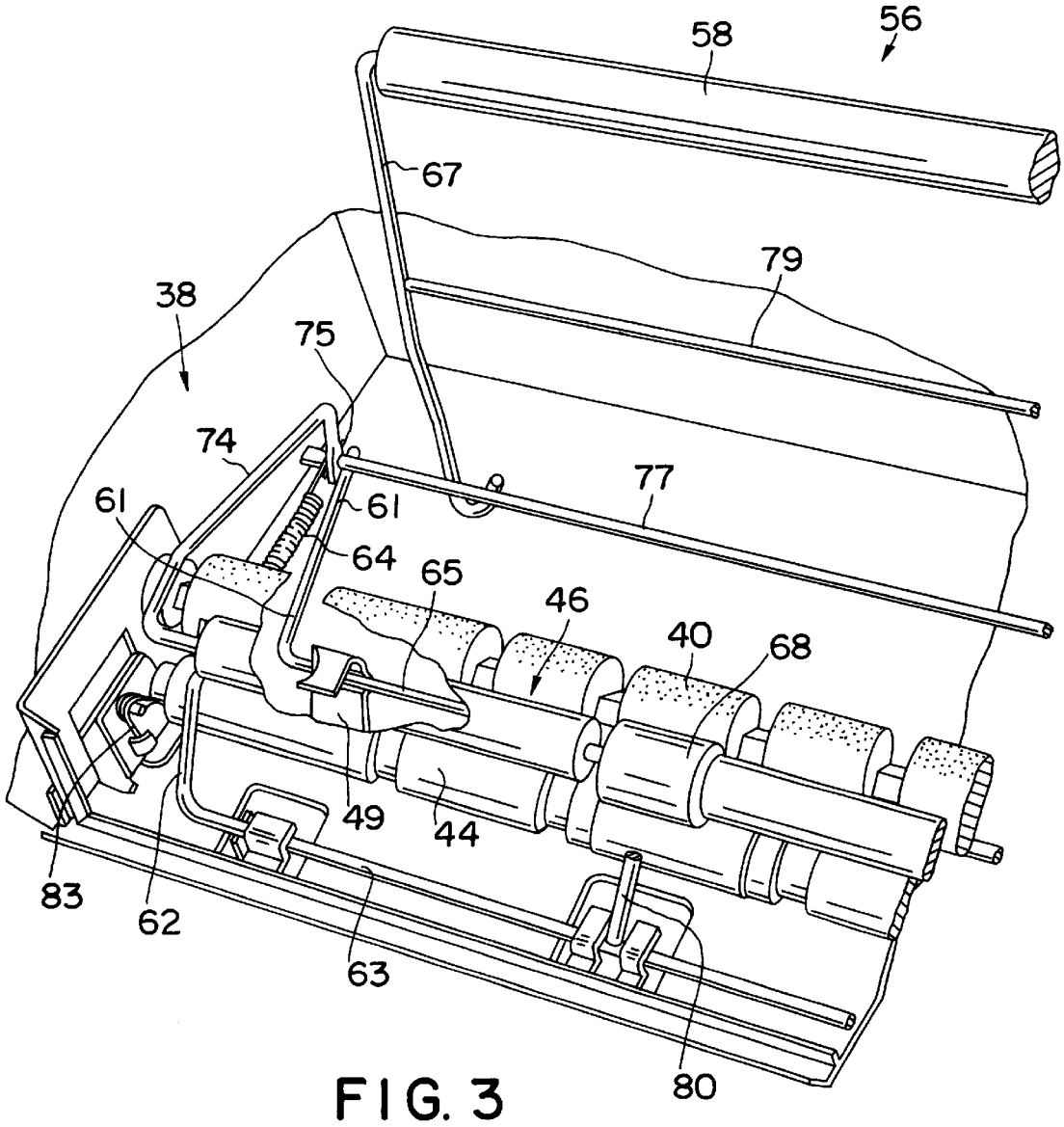
FIG. 3 is a detailed view of the feed mechanism and trigger device according to the invention.

Dispenser 10 includes a movable guide member, generally 66. In the embodiment illustrated in the figures, guide member 66 may be a deflection roller 68. Deflection roller 68 is movable between a staging position wherein it is spaced from the feed mechanism, as particularly illustrated in FIG. 5*a*, to an operating position wherein it moves material 36 from the second roll into nip 46 of the feed mechanism 38, as particularly illustrated in FIG. 5*c*. Deflection roller 68 has a movable axis and is pivotally mounted by way of side arms 62 and a base member 63. Base member 63 is pivotally mounted to a bottom surface of housing 12, as particularly illustrated in FIG. 3. Thus, the pivot point for deflection roller 68 is defined by base member 63.

Figure 5B:
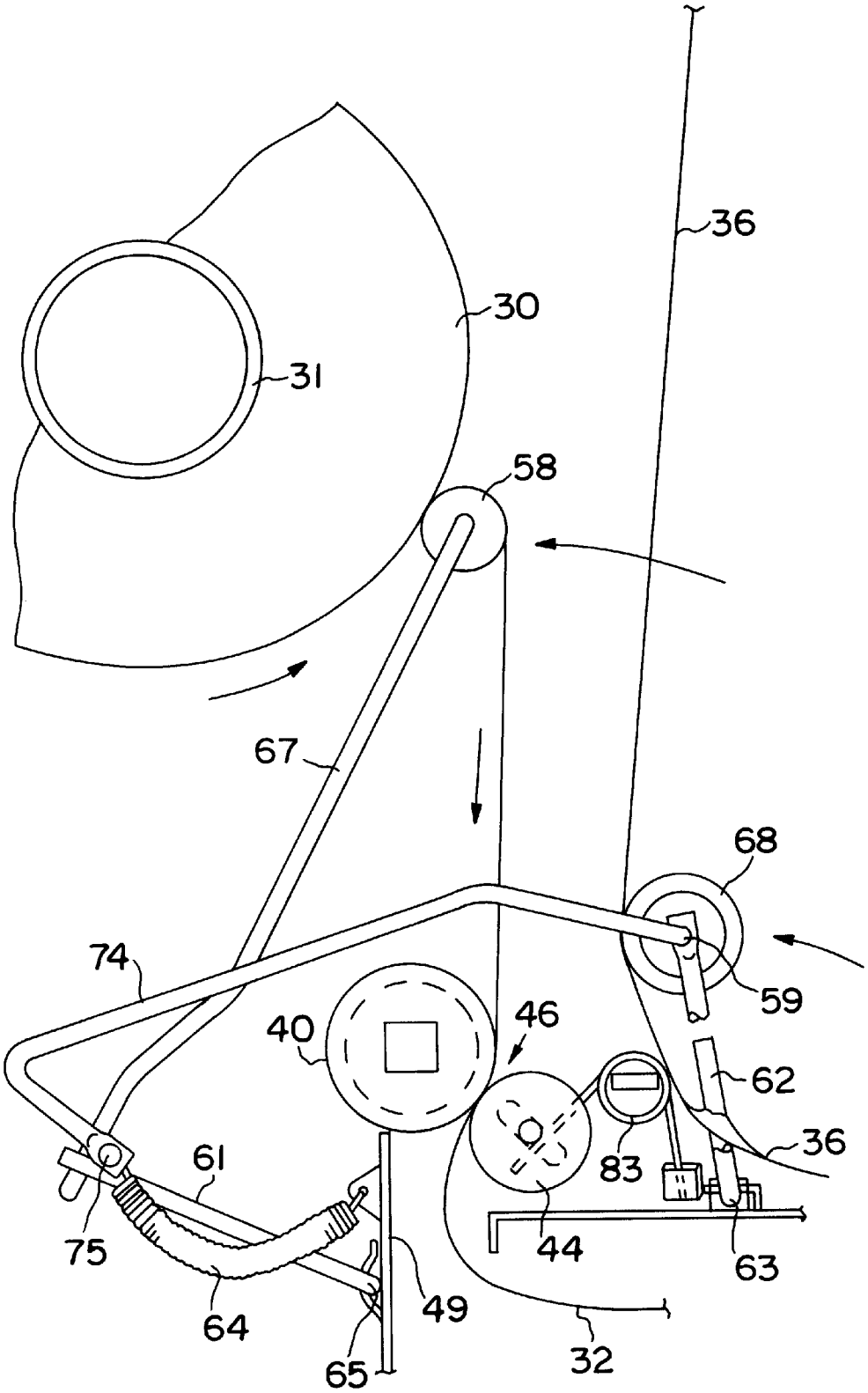
Figure 5C:
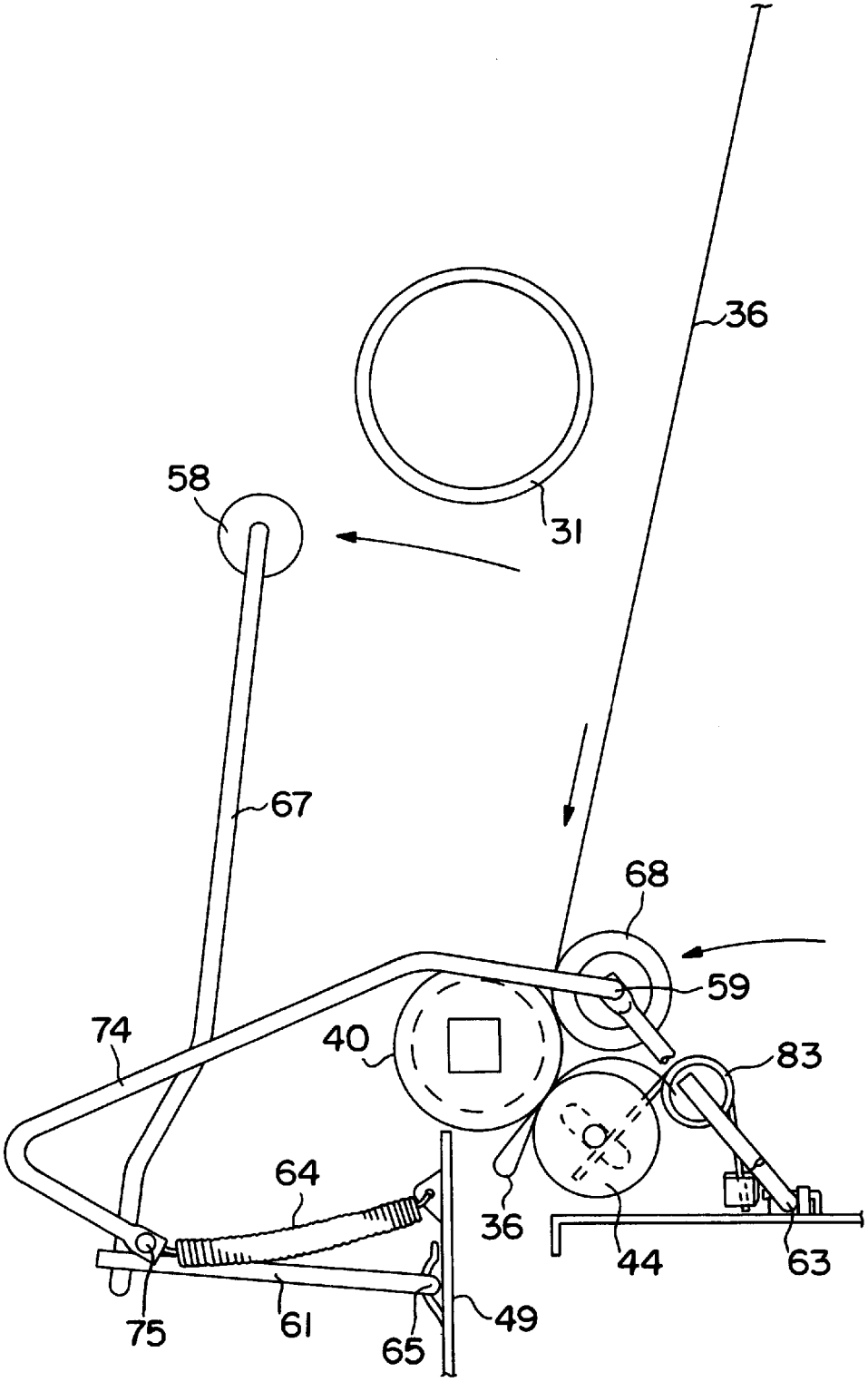

In the staging position of deflection roller 68, sheet material 36 from the second roll is deflected over a portion of the circumference of deflection roller 68 and directed to holding mechanism or pin 80. Material 32 from first roll 30 will be dispensed while material 36 is held in this position. Eventually, first roll 30 will be depleted to such a degree that it is desired to then dispense material 36 from second roll 34. Upon this condition, deflection roll 68 moves towards feed mechanism 38, and particularly feed roller 40, thereby deflecting the path of material 36 to the dispensing nip 46, as illustrated in FIG. 5*c*. The mechanism for causing this movement of deflection roller 68 from the staging position to the operating position will be discussed in greater detail below.

In the operating position illustrated in FIG. 5*c*, it can be seen that initially material 36 will be folded into nip 46 and dispensed in this folded condition until a free end of material 36 emerges from nip 46. Also, it should be understood that, although not illustrated in FIG. 5*c*, material from first roll 30 may be simultaneously dispensed with material 36 from the second roll until the material from the first roll is completely exhausted.

Dispenser 10 also includes a trigger device, generally 56, to move deflection roller 68 from the staging position shown in FIG. 5*a* to the operating position shown in FIG. 5*c* upon the first roll 30 being depleted to a predetermined amount. In the embodiment illustrated, trigger device 56 comprises a trigger roller 58 having an axis generally parallel to deflection roller 68. Roller 58 is biased against a longitudinally extending circumferential surface of first roll 30 and moves with the first roll as it is reduced in diameter upon depletion thereof, as illustrated in FIG. 5*b*. Trigger roller 58 is pivotally mounted to housing 12 to allow for the traveling motion of trigger roller 58. In the embodiment illustrated, trigger roller 58 is held by pivotally mounted arms 67. Referring particularly to FIGS. 2 and 5*a* through 5*c*, arms 67 may incorporate an intermediate horizontally extending brace or arm 79 connecting arms 67. The arms 67 are connected to a second set of arms 61 that extend at an angle from arms 67. In the embodiment illustrated, arms 67 are welded to arms 61. However, it should be understood that the configuration of arms 61 and 67 can be formed by any manner, including being formed from a single piece of rod or wire material, and the like. Arms 61 are pivotally mounted by a bottom cross arm 65 to housing 12, for example, as particularly seen in FIG. 3, cross arm 65 is pivotally held by a vertically oriented flange or wall member 49.

As trigger roller 58 moves to the left as the diameter of roll 30 decreases, its motion is transferred to deflecting roller 68 by way of any conventional linkage arrangement. For example, in the embodiment illustrated, linkage arms 74 are pivotally connected to arms 61 at pivot point 75. Arms 74 also form the axis of deflection roller 68 in that they are bent at a right angle to define the axis. Pivotal arm members 62 for deflection roller 68 are pivotally mounted to arms 74 at pivot point 59. It should be appreciated that this combination of linkage elements is merely one example of any number of suitable mechanical linking devices or arrangements.

The operation of the trigger device 56 can be seen in the sequential views of FIGS. 5*a* through 5*c*. As first roll 30 is reduced in diameter upon depletion thereof, trigger roller 58 is biased against the outer circumference of roll 30 and thus moves in an arc in the direction indicated in the figures. At some diameter of roll 30, for example at the apex of its arc, trigger roller 58 will pass beyond and out of contact with first roll 30. Once this happens, trigger roll 58 is free to move to the trigger position illustrated in FIG. 5*c* wherein deflection roller 68 is brought into contact with feed roller 40. Only at this time will feed roller 40 frictionally engage and advance material 36 from second roll 34.

Applicants have found that a much more precise and reliable transfer of material from the first roll to the second roll is accomplished if trigger roller 58 is allowed to move a substantial distance to the trigger position. The reliability and consistency of the transfer operation is improved if actuation of the deflection roller 68 from its staging position to the operating position is not dependent upon a minute degree of travel of deflection roller 58, for example if deflection roller 58 were kept in contact with the diameter of the first roll. In other words, the transfer or trigger operation is not dependent upon the degree of compressibility of the material of the first roll, defects in the surface contour of the first roll, etc. According to the invention, once the trigger roller or device 58 moves out of contact with the first roll, it will then move a substantial degree to the trigger position which in turn causes deflection roller 68 to move to the operating position.

It should be appreciated by those skilled in the art that various modifications and variations can be made in the present invention without departing from the scope and spirit of the invention. It is intended that such modifications and variations be included in the application as come within the scope of the appended claims and their equivalents.

What is claimed is:

1. A roll dispenser configured for dispensing at least two rolls of material, comprising:

a housing, said housing further comprising a first roll retaining device and a second roll retaining device for holding first and second rolls of material within said housing;

a feed mechanism disposed within said housing to dispense material from the first and second rolls;

a movable guide member disposed within said housing, said guide member movable between a staging position spaced from said feed roller and an operating position wherein said guide member contacts and moves material from the second roll to proximate said feed mechanism;

a movable trigger roller disposed so as to extend longitudinally against an outer circumferential surface of the first roll as the first roll is reduced in diameter with depletion thereof; and wherein upon the first roll being depleted to a certain diameter, said trigger roller passes beyond and out of contact with the first roll to a trigger position, said trigger roller operably connected to said guide member so as to move said guide member to said operating position upon said trigger roller moving to said trigger position.

2. The roll dispenser as in claim 1, wherein said guide member comprises a deflection roller.

3. The roll dispenser as in claim 2, wherein in said staging position said deflection roller deflects the second roll material to a holding member that retains the second roll material, and in said operating position said deflection roller moves to a position that causes the second roll material to be withdrawn from said holding member and directed to said feed mechanism.

4. The roll dispenser as in claim 3, wherein said deflection roller is disposed against said feed roller in said operating position.

5. The roll dispenser as in claim 1, wherein said trigger roller is carried by at least one pivotally mounted arm member.

6. The roll dispenser as in claim 5, wherein said arm member is mechanically linked to said guide member.

7. The roll dispenser as in claim 6, wherein said guide member comprises a deflection roller disposed generally parallel to said trigger roller, said deflection roller carried by a pivotally mounted frame member linked to said trigger roller arm member.

8. The roll dispenser as in claim 1, wherein said trigger roller is carried by at least one pivotally mounted arm member such that when the first roll is depleted, said trigger roller moves in an arc and moves out of contact with the first roll at an apex of said arc relative to the first roll.

9. A multiple roll dispenser configured for sequentially dispensing material from at least two rolls, comprising:

a housing, said housing further comprising a first roll retaining device and a second roll retaining device disposed for holding first and second rolls of material in a generally vertically stacked alignment within said housing;

a driven feed roller having a fixed axis mounted within said housing;

a nip roller disposed against said feed roller to define a dispensing nip therewith through which the roll material is frictionally engaged and dispensed from said housing;

a deflection roller movable between a staging position spaced from said dispensing nip and an operating position wherein said deflection roller is proximate to said dispensing nip for deflecting material from the second roll into said dispensing nip; and a biased trigger device disposed so as to contact a longitudinal circumferential surface of the first roll as the first roll is reduced in diameter, said trigger device pivotally mounted below said retaining devices and movable in an arc as the diameter of the first roll is reduced, said trigger device operably connected to said deflection roller so as to move said deflection roller to said operating position when said trigger device moves out of contact with the first roll.

10. The dispenser as in claim 9, wherein said arc defines the degree of depletion of the first roll that causes said deflection roller to move to said operating position.

11. The dispenser as in claim 10, wherein said trigger device is carried by at least one pivotally mounted arm member having a length defining a radius of said arc.

12. The dispenser as in claim 9, wherein said trigger device comprises a longitudinally extending trigger roller disposed generally parallel to an axis of the first roll.

13. The dispenser as in claim 12, wherein said trigger roller is carried by at least one spring biased arm member.

14. The dispenser as in claim 13, wherein said deflection roller is carried by a pivotally mounted frame member linked to said spring biased arm member.

15. The dispenser as in claim 9, further comprising an actuating device operably configured with said feed roller to rotate said feed roller.

16. The dispenser as in claim 15, wherein said actuating device is a manually operated member.

* * * * *